US006216509B1

(12) United States Patent
Lotspaih et al.

(10) Patent No.: US 6,216,509 B1
(45) Date of Patent: Apr. 17, 2001

(54) HYDROFORMED TUBULAR MEMBER AND METHOD OF HYDROFORMING TUBULAR MEMBERS

(75) Inventors: Steven R. Lotspaih, Cedarburg; Wallace R. Birtch, Menomonee Falls, both of WI (US)

(73) Assignee: R.J. Tower Corporation, Grand Rapids, MI (US)

( * ) Notice: Subject to any disclaimer, the term of this patent is extended or adjusted under 35 U.S.C. 154(b) by 0 days.

(21) Appl. No.: 09/139,821

(22) Filed: Aug. 25, 1998

(51) Int. Cl.[7] ..... B21D 26/02
(52) U.S. Cl. ..... 72/61
(58) Field of Search ..... 72/58, 57, 61, 72/62

(56) References Cited

U.S. PATENT DOCUMENTS

| | | | | |
|---|---|---|---|---|
| Re. 33,990 | | 7/1992 | Cudini . | |
| 2,849,877 | * | 9/1958 | Nielsen et al. | 72/62 |
| 3,238,610 | | 3/1966 | Berg . | |
| 3,486,703 | * | 12/1969 | Sorlie | 72/61 |
| 3,572,073 | * | 3/1971 | Dean | 72/62 |
| 4,567,743 | | 2/1986 | Cudini . | |
| 4,759,111 | | 7/1988 | Cudini . | |
| 4,829,803 | | 5/1989 | Cudini . | |
| 4,840,053 | * | 6/1989 | Nakamura | 72/62 |
| 5,016,805 | | 5/1991 | Cadwell . | |
| 5,070,717 | | 12/1991 | Boyd et al. . | |
| 5,333,775 | | 8/1994 | Bruggemann et al. . | |
| 5,475,911 | * | 12/1995 | Wells et al. | 72/61 |
| 5,481,892 | | 1/1996 | Roper et al. . | |
| 5,697,155 | * | 12/1997 | Bloecker et al. | 72/62 |
| 5,711,059 | | 1/1998 | Schaefer . | |
| 5,715,718 | | 2/1998 | Rigsby et al. . | |
| 5,718,048 | | 2/1998 | Horton et al. . | |
| 5,787,585 | | 8/1998 | Rashid . | |
| 5,927,120 | | 7/1999 | Marando . | |
| 5,953,945 | * | 9/1999 | Horton | 72/58 |

FOREIGN PATENT DOCUMENTS

| | | | | |
|---|---|---|---|---|
| 61-37327 | * | 2/1986 | (JP) | 72/62 |
| 1269893 | * | 11/1986 | (SU) | 72/62 |

* cited by examiner

*Primary Examiner*—David Jones
(74) *Attorney, Agent, or Firm*—Craig J. Lervick; Oppenheimer, Wolff & Donnelly LLP

(57) ABSTRACT

Tubular members for use in vehicle frames are easily and economically produced using a hydroforming process in which a high pressure fluid is presented to the interior of a tubular member, thus causing the tube to expand to meet the interior walls of a forming die. Tubular members can be formed having significant variations in their circumference, diameter along their lengths, or gage along their lengths by using a stamped blank having a predetermined shape which is formed into a preformed tube which roughly mirrors the shape of the desired finished tubular member.

11 Claims, 3 Drawing Sheets

HYDROFORMED TUBULAR MEMBER AND METHOD OF HYDROFORMING TUBULAR MEMBERS

BACKGROUND OF THE INVENTION

The present invention relates to structural members used in constructing vehicle frames. More specifically, the present invention relates to structural members that are generally tubular and to a method of forming such structural members. Still more specifically, the present invention relates to structural members that are fabricated using hydroforming which are generally tubular and vary significantly in circumference, gage, or cross section along their lengths.

In many instances, it is necessary to create structural members such as frames or mounting components to provide overall support to other devices. This is particularly true in the manufacture and assembly of vehicles such as automobiles, trucks, sport utility vehicles and the like. Such a vehicle frame is shown in U.S. Pat. No. 5,149,132 entitled "Split Rear Truck Frame" which is assigned to the assignee of the present invention and is incorporated herein by reference. Another example of such a truck frame and its related mounting structures can be found in U.S. Pat. No. 5,308,115 entitled "Vehicle Frame With Overlapped Sections", also assigned to the assignee of the present invention and incorporated herein by reference.

A vehicle is assembled, at least in part, by constructing a frame and attaching components to the frame. Vehicle components may include the engine cradle, the suspension system, body panels, control arms, rear box load, cab, brake and fluid lines, and the like. The frame typically includes two generally parallel, spaced-apart side rails which run substantially the length of the vehicle. Cross-members span the distance between the side rails. Vehicle components are attached to the frame directly such as by bolting, riveting, or welding, or indirectly through brackets or other mounting structure.

Typically, components of these frames and structural members are manufactured by stamping plate steel onto desired configurations. These stamping or manufacturing operations require the use of very large presses which impart large amounts of force to a work piece. In the stamping operation, plate steel is first cut or formed into blanks of a predetermined configuration. The blanks are then placed within a press and are stamped or formed into a desired shape. For example, long pieces or blanks can be stamped into a C-shaped beam or rail. This configuration is then capable of providing greater strength when supporting or handling loads.

While stamping operations can produce components and parts in an economical fashion, several drawbacks exist. Most significantly, when stamping occurs, repeatability and consistency among parts is not always achieved. When metal is pressed into a desired shape, it tends to have an elastic characteristic causing the part to "spring back" somewhat. This spring-back characteristic is difficult to predict and is not necessarily repeatable. Consequently, high repeatability of stamped components is difficult.

Stamping operations also create inconsistencies in the work hardening of parts. More specifically, the part is "hardened" at the bend points, whereas the remaining portions of the part are generally unaffected. This results in inconsistencies in material characteristics throughout the part which can complicate the predictability of the performance of the part.

The configuration of parts is somewhat limited by stamping and bending operations. Complex parts having complicated geometries cannot always be fabricated due to limitations in the stamping process. Even when it is possible to fabricate a complex part, many separate stamping and bending operations are required to achieve the desired configuration, thus increasing costs.

A number of the parts of the frame or its components are preferably formed by generally tubular members. Tubular members are advantageous because they provide strength without excessive weight and cost and because they can easily accommodate attachment to other parts. To create tubular members and other complex geometries in a part using a stamping process, numerous individual portions of the part are typically stamped and then welded together. However, this welding process is far from ideal. Welding of numerous components requires the use of several holding or welding fixtures to configure the parts appropriately. Further, during the actual welding process, distortion is created due to heating and cooling of the parts. This distortion is very hard to control and is not necessarily repeatable, thus creating inconsistencies between components.

Mass production of stamped parts also tends to be expensive. Multiple tools are required to manufacture multiple parts. Each of these tools must be consistently designed and manufactured. The use of multiple tools complicates the manufacturing process and adds costs to the product. An additional process sometimes used for fabricating structural components is hydroforming. In the hydroforming process, a unformed part or tube is placed in a die. The interior of the tube is then pressurized causing the tube to expand to meet the interior surface of the die. By carefully configuring the die to meet the part configuration desired, tubular parts can thus be manufactured.

As is well known, the hydroforming is somewhat limited. Specifically, wide variations in cross section are required for the finished part. Hydroforming does not provide a feasible method for manufacturing. These variations require expansion of the unformed tube at a rate or level that is typically beyond acceptable levels. Therefore, this process is not easily utilized to fabricate such parts.

SUMMARY OF THE INVENTION

The present invention uses a much different manufacturing process to formulate parts for use as various structural assemblers (e.g. brackets, frames, etc.). The process is adapted to produce consistent parts which are repeatable and consistent because little stamping and welding are used. Further, the present invention uses the process which forms tubular members having significant variations in their circumference or diameter along their length. "Tubular" as used throughout shall describe a member that has a wall that completely or substantially circumscribes an interior space, regardless of the circumferential or peripheral shape of the member.

In the process of the present invention, tubular members are manufactured using a pressurizing process known as hydroforming. Typically, the process begins with a simple tube cut to a desired length. This preformed tube is selected to have a diameter that is approximately equal to the smallest diameter of the finished tube shape. The tube is then placed into a hydroforming die which is configured to completely enclose the tube. Once placed within the hydroforming die, a fluid is presented and pressurized within the tube thus causing expansion of a portion or all of the tube. The expanding material conforms to the shape of the hydroforming die to create the formed tube. Finally, the formed tube is removed from the die and is cut to the desired length.

The ability of a tube to expand under hydroforming depends upon many factors, including the material used, the wall thickness, the specific hydroforming process used, and the strength required in the resulting part. Typically, a metal tube is able to expand some reasonable amount across its diameter during the hydroforming process. Greater expansion can result in weak or thin walls in the resulting formed tube. Also, the resulting formed tube can have a fairly complex shape. That shape is limited, however, to having relatively small variations in diameter along its length if the preformed tube is cylindrical. That is, since the preformed tube must have a diameter approximately equal to the smallest diameter of the desired finished tube, and since the tube is only able to expand some reasonable amount, the resulting tube can have only limited variations in diameter between its smallest portion and its largest portion. In many applications, this variation is limited to changes of only ten percent or less.

To form a part that has significant variation in its circumference, variations in cross-sectional area, variations in gage along its length, or variations in diameter along its length, the present invention starts by forming a non-cylindrical metal tube. This non-cylindrical tube is formed by first stamping a blank from a sheet of material. The blank has a shape which, when rolled or formed so that its longitudinal edges meet, forms "a tube" having a varied diameter or circumference along its length. In one example configuration, a blank shaped like a truncated pie wedge is rolled or formed to form a frusto-conical shaped preformed tube. The resulting preformed conical tube can then be expanded by about ten percent at any desired points along its length, resulting in a finished formed tube that can have variations in diameter that exceed ten percent. In other words, by starting with a preformed tube that approximately mirrors the desired resulting shape, the hydroforming process can be used to create relatively complexly shaped parts that have significant variations in their diameter or circumference along their length.

The process of hydroforming is capable of better repeatability and precision in the configuration of the formed product. Consequently, a much more repeatable and efficient process is created. During the process, the metal tube is fully yielded to the configuration of the die. This eliminates the spring-back that is typically encountered in the stamping process. Further, because a more complex die can be used, the need for welding is substantially reduced and/or eliminated. Because little welding is used, the associated distortions are not encountered.

It is an object of the present invention to create a process for manufacturing and forming tubular members in a repeatable and consistent manner. This repeatability and consistency is achieved through the use of the hydroforming process.

It is a further object of the present invention to create a process for manufacturing and forming tubular members having a significant variation in circumference or diameter along their length.

It is an additional object of the present invention to provide a process for manufacturing a part which has variations in gage along the length of the part.

It is another object of the present invention to create a process for manufacturing and forming tubular members having a diameter variation greater than ten percent along their length.

It is an additional object of the present invention to reduce fabrication costs in the creation of structural components.

It is yet a further object of the present invention to produce repeatable, consistent parts.

Further objects and advantages of the present invention will be understood by those of skill in the part from the detailed description below in conjunction with the drawings.

BRIEF DESCRIPTION OF THE DRAWINGS

In the drawings, in which like numerals are used throughout to identify corresponding elements through several views.

The drawings constitute a part of the specification and illustrate preferred embodiments of the present invention. It will be understood that in some instances, relative component and material thicknesses may be shown exaggerated to facilitate explanation.

DETAILED DESCRIPTION OF THE PREFERRED EMBODIMENT

Figure 1:
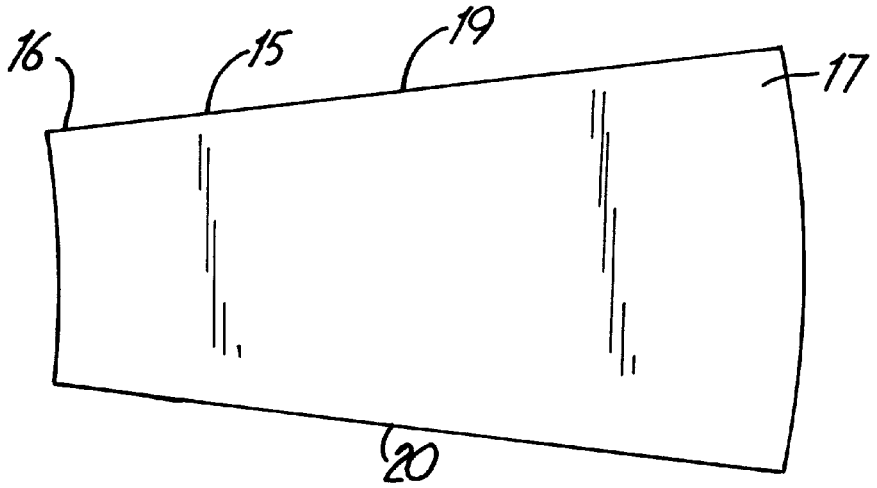
FIG. 1 is a top elevational view of a blank used to form a preformed tube according to the process of the present invention.
Figure 4:
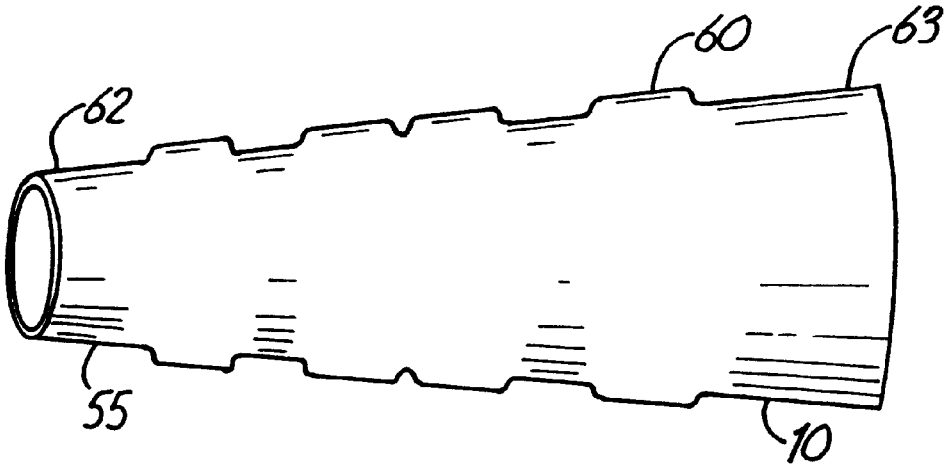
FIG. 4 is a side elevational view of a formed tube formed according to the process of the present invention.

The process of manufacturing a formed tubular member 10, like that illustrated in FIG. 4, begins with a blank 15 that is stamped from a sheet of metal, such as steel, aluminum or alloy, or other appropriate material. The blank illustrated in FIG. 1 is roughly shaped like a truncated pie wedge, with one end 16 being generally smaller in width than the opposite end 17. The blank 15 is generally planar and has opposite longitudinal edges 19 and 20. The blank 15 tapers gradually from its small end 16 to its larger end 17. The longitudinal edges 19 and 20 become mating edges when the blank 15 is formed about its longitudinal axis in a manner known in the art. For example, a 3 or 4 roll rolling machine can be used to roll blank 15 such that edges 19 and 20 meet.

Figure 2:
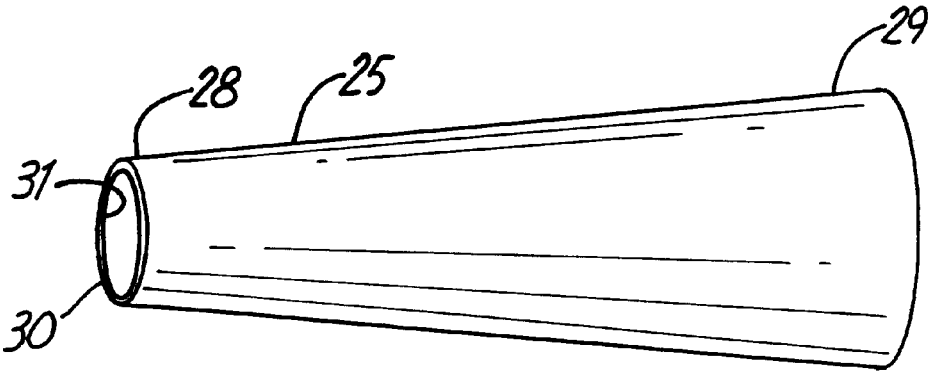
FIG. 2 is a side elevational view of a preformed tube formed by bending, rolling, or otherwise processing the blank of FIG. 1 so that its longitudinal edges meet in accordance with the process of the present invention.

Once the blank 15 has been formed into the desired "tube" shape, as illustrated in FIG. 2, the mating edges 19 and 20 are welded together by a method known in the art that is suitable for the material of the tube, such as gas metal arc welding, high frequency welding, mash seam welding, or the like. The preformed tube 25 is generally frusto-conical shaped, tapering from a portion 28 with a small diameter to an end 29 with a larger diameter. The preformed tube 25 generally consists of a wall 30 which circumscribes an interior space 31.

Figure 3:
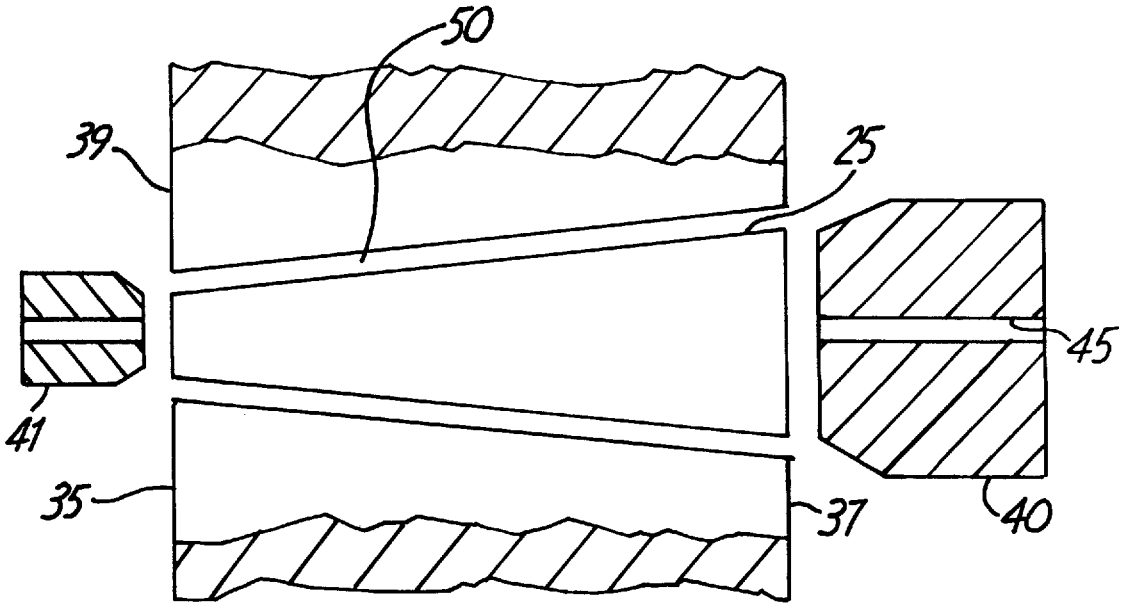
FIG. 3 is an exploded view showing the hydroforming die and the preformed tube in the die's open position.

Next, the preformed tube 25 is placed in a hydroforming die 35 as illustrated in FIG. 3. The tube 25 is an appropriate length to fit within the hydroforming die 35. The lower half 37 and the upper half 39 of the hydroforming die 35 are then closed about the preformed tube 25. Both ends of the hydroforming die 35 are configured to have a circular opening to accommodate the insertion of a first ram 40 or a second ram 41. In one embodiment of the invention, two rams 40 and 41 are used, one positioned at each end of the hydroforming die 35. In this embodiment, the first ram 40 is inserted into the opening of the hydroforming die 35 and a fluid is injected via central orifice 45. This fluid causes all air to be flushed out of the tubular member 25. Next, while this fluid is still flowing, second ram 41 is inserted into the opposite end of the hydroforming die 35. The hydroforming die 35 and the first and second rams 40 and 41 create a closed chamber which will accommodate a high pressure cycle.

The fluid is pressurized to high pressure, causing the circular tube to expand until it meets an interior wall 50 of the die. Once this process is complete, the pressure is removed and the rams 40 and 41 are withdrawn, thereby allowing the formed tube to be removed. To remove the formed tube, the upper and lower halves of the die 37 and 39 are separated, thus opening the die 35.

As noted above, the die 35 of FIG. 3 includes upper and lower halves 39 and 37. In another embodiment of the present invention, die 35 is made up of numerous sections. For example, die 35 could be configured to have four separate sections, top, bottom and two side members. The use of a multi-piece die in this embodiment is better adapted to accommodate the removal of a formed tube. More specifically, certain configurations of formed tubes may tend to become lodged in sections of die 30. By using multiple sections to form die 35, this lodging or sticking can be avoided. Additionally, independent manipulation of each die section will increase flexibility during the manufacturing process.

FIG. 4 illustrates a formed tube 55 made from the blank illustrated in FIG. 1. The formed tube 55 includes one or more protrusions 60 in its outer peripheral surface. Generally, the shape of the formed tube 55 tapers from its larger end 63 to its smaller end 62. The shape of the formed tube 55 depicted in FIG. 4 is illustrative of the formed tubes that can be formed by the process of the present invention. It will be understood that the shape of a formed tube is dependent upon the shape of the interior wall of the die 35 which in turn is determined by the desired configuration of the resulting part. For example, a finished formed tube made according to the process described can be generally rectangular in cross-section, rather than generally circular in cross-section.

By using a preformed non-cylindrical tube in the hydroforming process, it is possible to achieve variations in the diameter of the finished tube that can exceed ten percent or whatever amount could otherwise have been achieved under the same conditions with a cylindrical tube. Further, greater consistency in the thickness of the wall of the finished tube can be achieved by starting with a preformed tube that generally or roughly parallels or mirrors the desired shape of the finished tube. Alternatively, the thickness, or gage, of the wall can be more closely controlled using the performed non-cylindrical tube described above. Consequently variations in thickness can be easily achieved.

Figure 5:
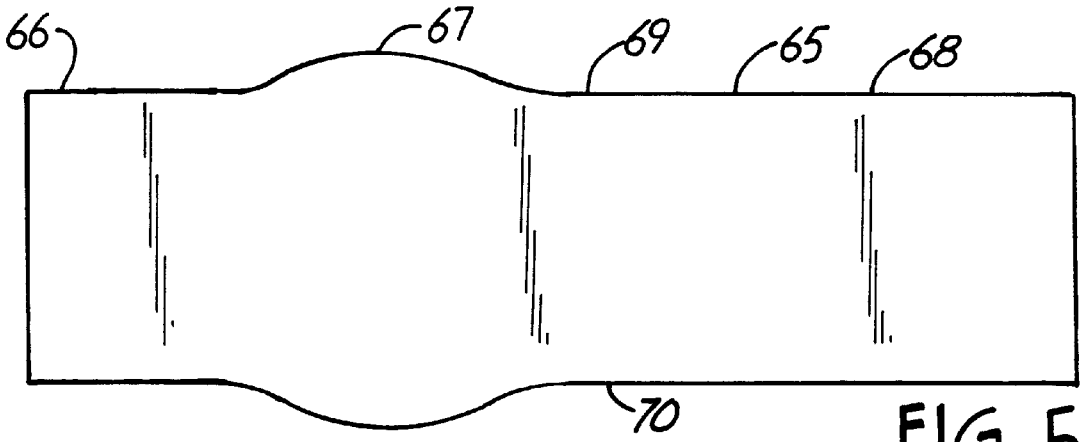
FIG. 5 shows an alternate shape for a preformed blank to be used in the process according to the present invention.
Figure 6:
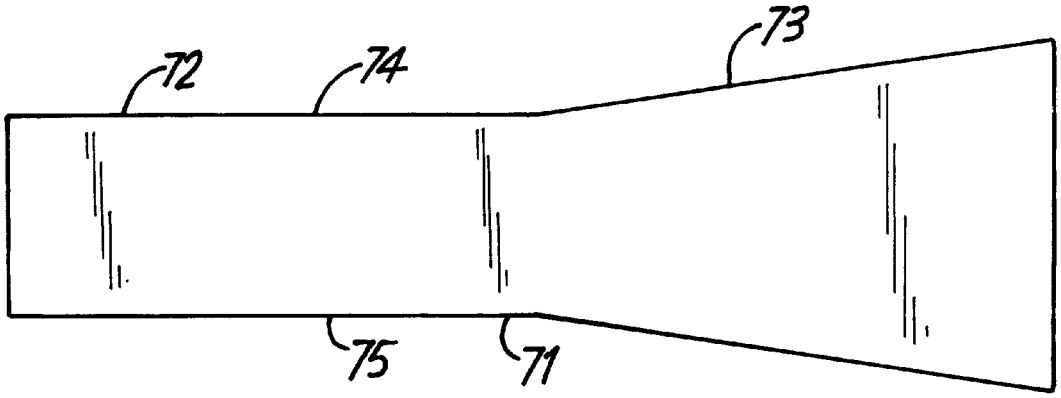
FIG. 6 shows an alternate shape for a preformed tube for use in a process according to the present invention.

FIGS. 5 and 6 show alternate examples of shapes for blanks to be used in the process described above. FIG. 5 shows a blank 65 that has a first generally rectangular portion 66 adjoining a second bulging portion 67 which in turn adjoins another rectangular section 68. Blank 65 has mating edges 69 and 70 which mate when the blank 65 is formed to form a generally tubular member.

FIG. 6 shows a blank 71 having a generally rectangular portion 72 adjoining a tapering portion 73. Blank 71 has opposite longitudinal edges 74 and 75 which mate when the blank 71 is rolled into a generally tubular member.

Various parameters can be used for the pressurizing operation of the present invention. For example, various pressure levels can be used depending upon the materials and configurations being obtained. The actual pressure levels used fall typically between 5,000 psi and 30,000 psi. The invention is not intended to be limited to this pressure range, however.

The hydroforming process has numerous advantages, including the elimination of many deficiencies and downfalls of previous manufacturing processes. As can be seen from the above description, each formed tube has been pressurized to match the shape and configuration of the interior die walls 50. Consequently, each product will be repeatable and consistent as the same die will be used repeatedly.

It is to be understood that even though numerous characteristics and advantages of the preferred embodiments of the present invention have been set forth in the foregoing description, together with details of the structure and function of the invention, the disclosure is illustrative only, and the present invention may be embodied in a variety of forms within the principles of the invention to the full extent indicated by the broad general meaning of the terms in which the appended claims are expressed. The above descriptions, therefore, are not to be interpreted as limiting, but rather as a basis for the claims and as a basis for teaching persons skilled in the art the invention, which is defined by the appended claims.

It is claimed:

1. Method of fabricating a tubular member comprising the steps of:

a) providing a blank of a predetermined shape having at least two different thicknesses;

b) forming the blank into an unformed tube having a cross-sectional area that varies along its length;

c) joining mating edges of the blank;

d) placing the unformed tube within an interior cavity in a forming die, wherein the forming die has a predetermined interior surface forming the interior cavity;

e) closing the forming die to enclose the unformed tube;

f) introducing a high pressure fluid to the interior cavity of the unformed tube, the high pressure fluid being of sufficient pressure so as to cause the unformed tube to expand so as to come in contact with the walls of the interior cavity, thus forming a formed tube having a configuration similar to that of the interior cavity.

2. A method according to claim 1 further comprising the step of:

a) after closing the forming die and prior to introducing a high pressure fluid, positioning a pressure ram adjacent the forming die such that a pressure opening in the pressure ram is in communication with an interior cavity of the unformed tube.

3. A method according to claim 1 further comprising the step of stamping at least two blanks from at least two sheets of material of different gauges and welding the blanks together to obtain a blank of a predetermined shape.

4. A method according to claim 1 wherein the forming die has a plurality of components each of which are independently positionable to form the interior cavity.

5. A method according to claim 2 further comprising the provision of a second pressure ram adjacent the forming die such that a pressure opening the second pressure ram is in communication with an interior cavity of the unformed tube, wherein the pressure ram and the second pressure ram cooperate to achieve the step of introducing high pressure fluid to the interior of the unformed tube.

6. A method according to claim 1 wherein said tube forming step yields a formed tube having a cross-sectional area that varies more than ten percent along its length.

7. A method according to claim 6 wherein said formed tube is generally frusto-conical in shape.

8. A method according to claim 1 wherein said unformed tube is frusto-conical in shape.

9. A method according to claim 1 wherein a portion of said formed tube is cylindrical in shape and a portion of said formed tube is frusto-conical in shape, said cylindrical and frusto-conical portions being continuous with one another.

10. A method according to claim 1 wherein said formed tube includes a portion having a diameter more than 10 percent larger than the smallest diameter of said unformed tube.

11. A method according to claim 1 wherein said formed tube includes a portion having a cross-sectional area more than ten percent larger than the smallest cross-sectional area of said unformed tube.

* * * * *